US008966858B2

(12) United States Patent
Sondermann

(10) Patent No.: US 8,966,858 B2
(45) Date of Patent: Mar. 3, 2015

(54) FLOOR PROFILE ARRANGEMENT

(75) Inventor: Frank Sondermann, Lüdenscheid (DE)

(73) Assignee: Küberit Profile Systems GmbH & Co. KG, Luedenscheid (DE)

( * ) Notice: Subject to any disclaimer, the term of this patent is extended or adjusted under 35 U.S.C. 154(b) by 240 days.

(21) Appl. No.: 13/375,703

(22) PCT Filed: Jun. 10, 2010

(86) PCT No.: PCT/EP2010/058184

§ 371 (c)(1),
(2), (4) Date: Jan. 24, 2012

(87) PCT Pub. No.: WO2010/149502

PCT Pub. Date: Dec. 29, 2010

(65) Prior Publication Data

US 2012/0110939 A1 May 10, 2012

(30) Foreign Application Priority Data

Jun. 26, 2009 (DE) ..... 20 2009 008 870 U
Jul. 8, 2009 (DE) ..... 20 2009 009 407 U

(51) Int. Cl.
*E04F 19/06* (2006.01)

(52) U.S. Cl.
CPC ..... *E04F 19/061* (2013.01)
USPC ..... 52/716.1; 52/288.1; 52/471; 52/585.1; 52/586.2; 49/467; 16/16

(58) Field of Classification Search
USPC ..... 52/211, 459, 460, 470, 471, 585.1, 52/586.1, 586.2, 716.1, 716.3, 287.1, 288, 52/604, 656.9, 848, 288.1; 16/16; 49/467; 403/292, 295, 298, 339, 340; 405/286
See application file for complete search history.

(56) References Cited

U.S. PATENT DOCUMENTS

| | | | | | |
|---|---|---|---|---|---|
| 433,219 | A | * | 7/1890 | Schwartz | 52/102 |
| 477,721 | A | * | 6/1892 | Webb | 404/7 |
| 763,485 | A | * | 6/1904 | Haussler | 16/7 |
| 1,250,594 | A | * | 12/1917 | Knapp | 52/288.1 |
| 1,288,226 | A | * | 12/1918 | Schrader | 446/122 |
| 1,495,022 | A | * | 5/1924 | Langer | 52/293.2 |

(Continued)

FOREIGN PATENT DOCUMENTS

| | | |
|---|---|---|
| DE | 297 11 960 U1 | 9/1997 |
| DE | 201 17 167 U1 | 1/2002 |

(Continued)

OTHER PUBLICATIONS

International Search Report (in German with English Translation) and Written Opinion for PCT/EP2010/058184, mailed Sep. 28, 2010; ISA/EP.

*Primary Examiner* — Robert Canfield
*Assistant Examiner* — Charissa Ahmad
(74) *Attorney, Agent, or Firm* — Harness, Dickey & Pierce, P.L.C.

(57) ABSTRACT

Floor profile arrangement, in particular for securing floor coverings (10), comprising at least one profiled strip (1) which has at least one retaining means (2) which holds a first segment (4) of a joining means (15), wherein a second segment (14) of the joining means (15) projects over a peripheral region (5) of the profiled strip (1) in the longitudinal direction (L) to join with a further profiled strip (1).

19 Claims, 7 Drawing Sheets

(56) References Cited

U.S. PATENT DOCUMENTS

| | | | | | |
|---|---|---|---|---|---|
| 2,449,904 | A | * | 9/1948 | Lorraine | 16/7 |
| 2,644,977 | A | * | 7/1953 | June | 16/7 |
| 2,788,551 | A | * | 4/1957 | Hildreth | 49/467 |
| 2,875,467 | A | * | 3/1959 | De Vault | 16/7 |
| 2,875,481 | A | * | 3/1959 | Erkkila | 49/467 |
| 2,915,794 | A | * | 12/1959 | Hillmann | 52/287.1 |
| 2,994,905 | A | * | 8/1961 | Franker, Jr. | 52/273 |
| 2,996,751 | A | * | 8/1961 | Roby et al. | 16/7 |
| 3,386,590 | A | * | 6/1968 | Gretz | 211/189 |
| 3,533,190 | A | * | 10/1970 | Johnson et al. | 49/501 |
| 3,543,326 | A | * | 12/1970 | Rohrberg et al. | 16/16 |
| 3,708,938 | A | * | 1/1973 | Tantlinger | 52/471 |
| 3,989,397 | A | * | 11/1976 | Baker | 403/205 |
| 3,990,187 | A | * | 11/1976 | Brown et al. | 49/467 |
| 4,205,486 | A | * | 6/1980 | Guarnacci | 49/501 |
| 4,555,869 | A | * | 12/1985 | Kenkel | 49/449 |
| 4,569,171 | A | * | 2/1986 | Kuhr et al. | 52/242 |
| 4,642,957 | A | * | 2/1987 | Edwards | 52/242 |
| 4,653,138 | A | * | 3/1987 | Carder | 16/4 |
| 4,730,432 | A | * | 3/1988 | Schafer et al. | 52/716.1 |
| 4,838,412 | A | * | 6/1989 | Backman | 198/838 |
| 4,840,440 | A | * | 6/1989 | Dieter | 312/140 |
| 4,893,449 | A | * | 1/1990 | Kemper | 52/464 |
| 4,899,507 | A | * | 2/1990 | Mairlot | 52/222 |
| 4,913,576 | A | * | 4/1990 | Grant, Jr. | 403/13 |
| 4,959,941 | A | * | 10/1990 | Schoeneberg | 52/664 |
| 4,986,042 | A | * | 1/1991 | Richardt | 52/102 |
| 5,046,791 | A | * | 9/1991 | Kooiman | 312/265.1 |
| 5,090,836 | A | * | 2/1992 | Hwang et al. | 403/295 |
| 5,199,237 | A | * | 4/1993 | Juntunen | 52/287.1 |
| 5,361,556 | A | * | 11/1994 | Menchetti | 52/561 |
| 5,377,447 | A | * | 1/1995 | Fritch | 47/33 |
| 5,452,963 | A | * | 9/1995 | Christensen | 404/6 |
| 5,485,703 | A | * | 1/1996 | Nordahl | 52/562 |
| 5,598,784 | A | * | 2/1997 | Kubsik et al. | 104/111 |
| 5,651,224 | A | * | 7/1997 | Brabant | 52/288.1 |
| 5,809,718 | A | * | 9/1998 | Wicks | 52/287.1 |
| 5,864,997 | A | * | 2/1999 | Kelly | 52/282.2 |
| 5,921,046 | A | * | 7/1999 | Hammond, Jr. | 52/564 |
| 5,924,815 | A | * | 7/1999 | Goto | 403/268 |
| 5,941,044 | A | * | 8/1999 | Sera | 52/655.1 |
| 5,974,753 | A | * | 11/1999 | Hsu | 52/506.01 |
| 6,138,426 | A | * | 10/2000 | Mork et al. | 52/562 |
| 6,195,953 | B1 | * | 3/2001 | Gitter et al. | 52/843 |
| 6,289,635 | B1 | * | 9/2001 | Procton et al. | 49/467 |
| 6,345,480 | B1 | * | 2/2002 | Kemper et al. | 52/395 |
| 6,502,359 | B1 | * | 1/2003 | Rambo | 52/396.04 |
| 6,550,192 | B1 | * | 4/2003 | Nelson et al. | 52/177 |
| 6,591,575 | B2 | * | 7/2003 | Benedettini | 52/716.1 |
| 6,594,959 | B2 | * | 7/2003 | Whitson | 52/102 |
| 6,694,691 | B2 | * | 2/2004 | Ku | 52/403.1 |
| 7,118,791 | B2 | * | 10/2006 | Martel | 428/40.1 |
| 7,210,272 | B2 | * | 5/2007 | Friday | 52/288.1 |
| 7,266,929 | B1 | * | 9/2007 | Allred et al. | 52/211 |
| D581,549 | S | * | 11/2008 | Thorkelson | D25/113 |
| 7,640,706 | B2 | * | 1/2010 | Stanchfield | 52/464 |
| 7,703,249 | B2 | * | 4/2010 | Rachak | 52/288.1 |
| 7,866,098 | B2 | * | 1/2011 | Cinnamon | 52/173.3 |
| 7,908,819 | B2 | * | 3/2011 | Neuhofer, Jr. | 52/747.1 |
| 7,959,372 | B2 | * | 6/2011 | Shanley | 404/2 |
| 8,092,114 | B2 | * | 1/2012 | Baur et al. | 403/254 |
| 8,240,942 | B2 | * | 8/2012 | Baur et al. | 403/292 |
| 8,266,862 | B2 | * | 9/2012 | Huang | 52/585.1 |
| 8,336,278 | B2 | * | 12/2012 | Smith et al. | 52/747.12 |
| 8,465,222 | B1 | * | 6/2013 | Ghauch et al. | 404/51 |
| 2003/0154678 | A1 | * | 8/2003 | Stanchfield | 52/468 |
| 2003/0177728 | A1 | * | 9/2003 | Ku | 52/403.1 |
| 2005/0011159 | A1 | * | 1/2005 | Standal et al. | 52/716.1 |
| 2005/0055936 | A1 | * | 3/2005 | Murphy et al. | 52/506.01 |
| 2006/0150565 | A1 | * | 7/2006 | Schacht et al. | 52/716.1 |
| 2006/0275078 | A1 | * | 12/2006 | Shaw et al. | 404/56 |
| 2007/0186502 | A1 | * | 8/2007 | Marsh et al. | 52/604 |
| 2008/0229690 | A1 | * | 9/2008 | Sharabi | 52/288.1 |
| 2008/0292396 | A1 | * | 11/2008 | Shanley | 404/2 |

FOREIGN PATENT DOCUMENTS

| | | | | | |
|---|---|---|---|---|---|
| EP | 1 284 331 | | | 2/2003 | |
| EP | 1338747 | A2 | * | 8/2003 | E06B 3/58 |
| GB | 2153889 | A | * | 8/1985 | E06B 1/32 |
| WO | WO-01/20101 | | | 3/2001 | |

* cited by examiner

FLOOR PROFILE ARRANGEMENT

CROSS-REFERENCE TO RELATED APPLICATIONS

This application is a 371 U.S. National Stage of International Application No. PCT/EP2010/058184, filed Jun. 10, 2010, and claims priority to German Patent application Nos. 20 2009 008 870.7 filed Jun. 26, 2009, and 20 2009 009 407.3, filed Jul. 8, 2009, the disclosures of which are herein incorporated by reference in their entirety.

The present invention relates to a floor profile arrangement, in particular for securing floor coverings, comprising at least one profiled strip which has at least one retaining means.

PRIOR ART

DE 201 17 167 U1 discloses a floor profile arrangement, in particular for bridging a join in a floor covering, comprising a base profile and a cover profile which can be mounted on the base profile. In this case, the base profile has a substantially horizontal leg for attaching to a substrate and two upwardly projecting legs. The cover profile is formed from two laterally projecting cover wings which bridge the join between two abutting floor coverings, and two downwardly projecting webs. To attach a floor covering or to bridge a join, the cover profile is arranged over the base profile such that the two downwardly projecting webs engage over the two upwardly projecting legs of the base profile. Due to the fact that floor profile arrangements are sold as cut goods, the problem arises of forming a clean abutment point at the cut edges of the profiles. It can be difficult for a fitter to lay two floor profile arrangements against one another and to match one with the other such that the cut edges of the profiles rest flush against one another, thereby leaving no gap.

Furthermore, it is a problem with previous floor profile arrangements when cut edges of two floor profile arrangements are arranged in a high traffic area because the profiled strips deform differently and over time can stick up from the floor region. Not only does this look unattractive, but it also harbours the risk of injury.

It is therefore the object of the invention to provide a floor profile arrangement which allows a fast and correct pre-assembly of the profiled strips with respect to one another.

It is also an object of the invention to provide a floor profile arrangement which has an increased stability at least along its cut edges.

These objects are achieved by the subject-matter of the independent claim 1. Features of advantageous developments of the invention are provided in the dependent claims.

In an advantageous configuration of a floor profile arrangement which in particular can be suitable for securing floor coverings and comprises at least one profiled strip, said profiled strip comprises at least one retaining means which holds a first segment of a joining means, a second segment of the joining means projecting over a peripheral region of the profiled strip in the longitudinal direction to join with a further profiled strip. In this respect, the longitudinal direction extends vertically to the cut edges of the profile.

In this context, the term "profiled strip" can be understood as meaning any component which is capable of receiving joining regions of floor coverings. For example, profiled strips can be a substantially ramp-shaped or H-shaped component so that the opposite legs form a channel-shaped structure. Thus, for example in the case of an H-shaped profiled strip, two U-shaped channels are provided for receiving floor coverings, the channels sharing a wall.

Such profiled strips are used as corner edge profiles, stair nosing profiles, edge profiles, angle profiles, transition profiles, border profiles, ramp profiles, end profiles, skirting boards and decorative strips.

In an embodiment of the invention, in the case of an angle profile, it is advantageous to also use at least one angle joint in addition to the connectors. The term "angle joint" is understood as meaning any component which is capable of joining two or more profiled strips which are at a predefined angle to one another. The most frequent case is that of an angle between two profiled strips of 90°, the profiled strips being cut in each case at an angle of 45° and joined together. The angle joint allows a positive connection of angle profiles at the cut edges. It is also favourable that the angle joint can be inserted ex factory and thus prefabricated angle elements which are joined together by an angle joint can be supplied.

The angle joint can be configured in one part and can be attached to the profiled strip(s) by an attachment means, such as screws, preferably set screws. For this purpose, the profiled strip can also comprise means which provide the attachment means with a planar contact surface. In the case of a ramp-shaped profiled strip, the screw would slip and tilt on the inclined surface. Thus, the means provided is a type of bead on the inclined surface which supports the screw vertically and prevents it from tilting. When the screw is tightened, the angle joint can be supported on legs provided on the profiled strip.

The advantage of a floor profile arrangement according to the invention is, on the one hand, the simplified assembly and, on the other, the saving of assembly costs and material costs. By using the joining means, the first segment of which is held in a profiled strip and the second segment of which protrudes over a peripheral region of the profiled strip in the longitudinal direction, it is easily possible for a first join with a further profiled strip to be produced on the projecting segment, without them being finally attached to one another.

It is also advantageous that the joining means can ensure an increased load bearing capacity when the profiled strips are finally attached to one another. In this respect, higher mechanical forces, such as normal forces and bending moments, can be transmitted from one profiled strip to the adjoining profiled strip. Thus, not only a transmission of force, but also a distribution of force is ensured. This increases the mechanical loading capacity and reduces mechanical wear.

Due to the increase in the absorption capacity of forces and moments, a profiled strip can configure a relatively great difference in height to be overcome between two floor coverings, since the joining means which can be introduced into the profiled strip increase the mechanical stability. Accordingly, the joining means also make it possible to bridge a high traffic area, because here as well, the joining means absorb the forces and can distribute or transmit them onto the support.

Furthermore, it is advantageous that the raising action, which often occurs after some time at the abutment point or at the contacting cut edges of two floor profile arrangements, of the abutting ends of the floor profile arrangements can be prevented. This behaviour is the result of plastic deformations corresponding to the load moments, caused by daily use. The use of at least one joining means can prevent this behaviour and can transmit and also distribute the load of bending and torsion moments and of normal forces from one profiled strip to an adjoining profiled strip.

In one configuration of the floor profile arrangement, it is also possible for the profiled strip to provide two or more retaining means, each of which can hold a joining element. This is of particular advantage when two relatively long profiled strips are joined together, because the load of bending and torsion moments and of normal forces is distributed over two or more joining means. Thus, for each individual joining means, the retaining moments or retaining forces are halved or reduced and consequently the mechanical stability of the entire system is enhanced. In the case of short profiled strips, the effect is also advantageous particularly in respect of a possible wobbling motion.

Furthermore, it is possible for the joining means to have an identical shape, the first joining means being arranged vertically and the second joining means being arranged horizontally in the respective profiled strip. In this respect, it is advantageous, for example in the case of a ramp-shaped floor profile arrangement, for the joining means to be cuboidal and to be arranged both vertically and horizontally inside a ramp-shaped profiled strip. Thus, a horizontal orientation of the joining means is preferred in the pointed front region of a ramp-shaped profiled strip, whereas a vertical orientation is possible in the opening region. Such a configuration makes it possible to keep production costs down for the joining means, since only a single mould for a joining means is required for joining two profiled strips. It is also possible to attach two identically oriented joining means next to one another or one above the other for the join.

In addition, the orientation possibilities of the joining means inside a profiled strip afford different mechanical advantages. Thus, when the join of two profiled strips is subjected to a bending stress by a tread load, it is advantageous to position the joining means on the profiled strip such that the section modulus concerned of the joining means is oriented as far as possible in the bending direction. Not only does this unload the joining means, but at the same time it increases the stability at the abutment point of the profiled strips.

The at least one retaining means can preferably be formed from webs and/or legs and/or a dovetail retaining means, the at least one retaining means providing retaining surfaces for holding the at least one joining means. Such a configuration of the at least one retaining means ensures that the at least one retaining means engages around the at least one joining means in both a non-positive and positive manner.

In one configuration of the at least one retaining means consisting of legs or webs, the at least one joining means can be introduced into the channel formed by the legs or webs. In this respect, it is advantageous for the shape and size of the joining means to at least match the size of the channel. It is thus possible to ensure a non-positive locking and a positive locking by the legs/webs engaging over the joining means. It is only by means of this non-positive and positive locking that bending moments arising at the abutment point of two profiled strips can be successfully transmitted from one profiled strip to the other directly or indirectly via the joining means. A positive locking of the profiled strips at the abutment point can also be achieved using the joining means. It is also possible to directly transmit normal forces which act in the extension direction of the joining means from one profiled strip to the other.

If the at least one retaining means is formed by a dovetail retaining means, the non-positive locking and positive locking is merely required on the dovetail retaining means. However, a positive locking is also possible via the webs and legs.

Furthermore, it is preferred if the at least one joining element can be secured in a detachable manner to the at least one retaining means.

This is advantageous because if a joining means is not initially correctly installed in the at least one retaining means, the joining means can be removed and then re-attached. The floor profile arrangement can also be reused several times in this way.

In this respect it is also advantageous to allow repositioning of the joining means by hand inside the retaining means. This is preferably adjusted by manufacturing tolerances when the profiled strip and the joining means are formed. The type of fit can be easily determined here so that a necessary retaining force is achieved.

Associated therewith is also the force required for installing the joining means in the profiled strip.

In order that the joining means is held more effectively inside a retaining means, it is advantageous for the at least one retaining means to have a profiling.

This profiling can be configured like a pattern, consisting of many small elevations and depressions, on the surface of the legs and/or webs.

This configuration is favourable for manually removing the joining means from the retaining means, because less force has to be overcome due to the reduction in the contact surface between joining means and retaining means. Furthermore, due to the profiling, the joining means which has been pressed in can be pushed out again in the longitudinal direction of the profile or the attachment site can be determined. Thus, an installation by insertion in the longitudinal direction of the profile can also be ensured.

Furthermore, it is also possible for the at least one joining means to be configured to engage in the profiling. Consequently, the contact surface between joining means and retaining means is increased and thus greater forces can be transmitted by the joining means. In addition, a profiling of the retaining means on the webs or legs and on the at least one joining means counteracts an inadvertent detachment of the joining means from the retaining means.

For the installation of an assembly, consisting of two profiled strips, with a joining means, it is advantageous if the profiled strip together with the at least one joining means forms a flush end surface on the lower side. In this respect, "on the lower side" means on the side of the floor profile arrangement facing the floor. This flush termination ensures the maximum amount of surface contact between the two profiled strips and the joining means, so that a maximum amount of forces and bending moments can be transmitted.

In an alternative configuration, the at least one joining means can also have at least one predetermined breaking point which makes it possible to adapt the length of the joining means to external factors.

It is also possible that at least one retaining means has a stop which limits the longitudinal displaceability for the at least one joining means.

The advantage of a longitudinally-limiting stop not only provides the adjustment of the optimum length inside the profiled strip for the transmission of forces and moments onto the adjoining profiled strip, but also affords the advantage of preventing a faulty installation of the joining means inside the retaining means. The insertion site of the at least one joining means is fixed; a defective assembly is ruled out.

In an alternative configuration, it is advantageous for the at least one joining means to be adhesively bonded to the at least one retaining means.

The advantage of this configuration is a correct and unchangeable pre-assembly of the joining means inside the retaining means ex works and prevention of a faulty installation of the joining means in the profiled strip or in the retaining means. Furthermore, it is thus possible to reduce production complexity and therefore production costs, since the manufacturing tolerances for a join of this type are significantly lower.

The joining means and/or the profiled strip and/or the retaining means advantageously have at least one recess for receiving adhesives. An advantage of such a configuration is the flow of liquid adhesive into these recesses, the hardened adhesive not only increasing the contact surface between opening means and profiled strip but, in the hardened state, it can also form a retaining hook.

Such a retaining hook is preferably obtained in that the recess in the retaining means only overlaps part of the recess in the joining means, so that when the adhesive has hardened, it can form a hook, one end of which being arranged inside the retaining means and the other end being arranged inside the recess in the joining means.

Furthermore, these recesses can be used for visually checking the position for a correct attachment of the joining means inside the profiled strip. It is thus made easier for the fitter to correctly attach the joining means.

The at least one joining element is preferably cuboidal, the recess in the relatively larger side of the cuboid being in contact with the retaining means.

The cuboidal shape ensures a simple and assured installation between joining means and retaining means. In this respect, it is particularly favourable if the largest surface of the cuboid or largest side of the cuboid is in contact with the retaining means, because in this way stress concentrations can be reduced during the transmission of forces along a large surface. At the same time, the friction adhesion is maximised between joining means, profiled strip and adhesive means introduced between them.

In a further preferred configuration, the joining means can have on its outside an adhesive film. As a result of using adhesive film, the fitter does not also have to deal with adhesives when installing the joining means in the retaining means of the profiled strip, and the same effect is achieved as with adhesives.

The joining means is preferably formed from plastics material or hard rubber. This provides the advantage of a simple and cost-effective production by injection moulding or casting methods, as well as soundproofing along the floor strip in itself.

Specifically when the joining means is made of hard rubber, it is possible to achieve a particularly good damping characteristic for vibrations and sound within a floor profile arrangement.

The above-mentioned features can be combined in any desired manner as long as they do not contradict one another technically. Thus, for example, it is also possible for the joining means and/or the retaining means to be configured such that an adhesive film as well as a profiling are provided. Thus, forces can be reliably transmitted along a smooth, adhesively bonded surface on one side and moments can be reliably transmitted vertically to the profiling on the other side.

Further features, advantages and different configurations of the invention are the subject of the following description and of the illustrations of embodiments.

BRIEF DESCRIPTION OF THE FIGURES

In the following, the invention will be described in more detail with reference to the figures, in which.

DESCRIPTION OF THE FIGURES

Figure 1A:
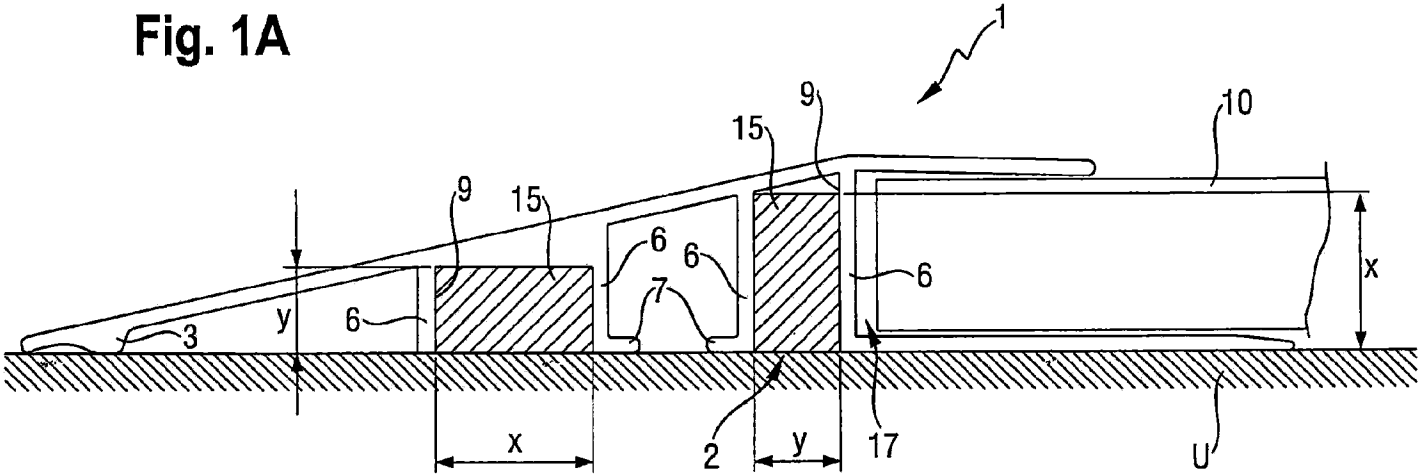
FIG. 1A shows a floor profile arrangement in a first embodiment.

FIG. 1A shows a floor profile arrangement in a side view and in the configuration of a profiled strip as a ramp profile.

The ramp profile has two sides, the upper side of which extends obliquely upwards and the lower extends parallel to the substrate U. On the outer lateral edge, the ramp profile has a support 3 which rests against the floor and supports forces arising from people treading on the floor. Continuing further in the horizontal direction, the upper side of the ramp profile is continued in a consistently oblique manner up to a bend into the horizontal. After the bend, the horizontal continuation extends to such an extent in the direction of an adjoining floor covering 10 that a joint gap 17 between floor covering 10 and profiled strip 1 is reliably covered. As shown in FIG. 1, the horizontal continuation is inclined towards the substrate U. On the one hand, this ensures a relatively small joint gap 17 between the continuation and the floor covering 10 and, on the other hand, this ensures a secure retention by clamping the floor covering.

The lower side of the profile has a repeatedly interrupted course, and it extends further than the horizontal continuation of the upper side in the direction of the floor covering. Thus, a surface is provided as an attachment facility on the substrate for screws and/or adhesives (not shown), for example.

To support forces which are caused on the upper side of the profiled strip 1 by people treading thereon, and to receive joining means 15, two retaining means 2 extend in the vertical direction from the upper side to the lower side or to the substrate U. The retaining means 2 are formed in each case by two webs 6 which are oriented parallel to one another and vertically to the substrate U.

The webs 6 in the centre region also have horizontally extending legs 7. Thus, the webs 6 with the legs 7 form an L shape, the legs 7 ensuring a planar contact with the substrate. By means of this advantageous configuration, compressive forces can be reduced or can be transmitted in a planar manner onto the substrate U.

Formed in each case between the webs 6 are retaining surfaces 9 to hold a joining means 15. The legs 7 are oriented such that the attachment of the L points away from the retained joining means 15. Thus, an undisturbed insertion of the joining means is ensured from the longitudinal direction L or from the lower side between two retaining surfaces 9. The fit of retaining surfaces 9 and joining means 15 is configured such that the join is non-positive and positive. Furthermore, the joining means 15 is attached in a removable manner on the at least one retaining means 2. FIG. 1 also shows that the profiled strip 1, together with the joining means 15, forms a flush end surface on the lower side. Thus, all the forces and moments acting on the profiled strip 1 can be transmitted onto the joining means 15 or onto an adjoining profiled strip. In addition, the flush termination prevents the profiled strip from tilting around the retaining means 2.

The web 6 facing the floor covering 10 can be continued on the lower side of the floor covering 10 on the substrate U (as shown).

The joining means 15 are shown in a sectional view and have identical measurements (x, y) in the vertical and horizontal directions, one joining means 15 being arranged horizontally and the other vertically. Due to the identical measurements, it is possible to interchange both means. This ensures low production costs, since the same joining means 15 can be used. The joining means 15 are preferably made of hard rubber or plastics material. Hard rubber affords the advantage of a particularly good damping characteristic for vibrations and sound inside a floor profile arrangement.

Joining means, such as an angle joint or the like, can also be introduced into a cavity formed from webs 6 and legs 7, but they have to be inserted laterally from the longitudinal direction L. In such a joining method, the inserted joining means can be attached to the profiled strip 1 by bonding and/or riveting and/or screwing.

The left-hand embodiment of a retaining means 2 with a joining means 15 shows how, compared to the right-hand embodiment, the gap between the upper edge of the joining means 15 and the upper side of the profiled strip 1 can be closed. Closure of the gap is achieved in that the retaining means 2 has a shape which exactly matches that of the joining means. Thus, greater forces and greater moments can be transferred from one profiled strip to another indirectly via joining means 15.

Figure 1B:
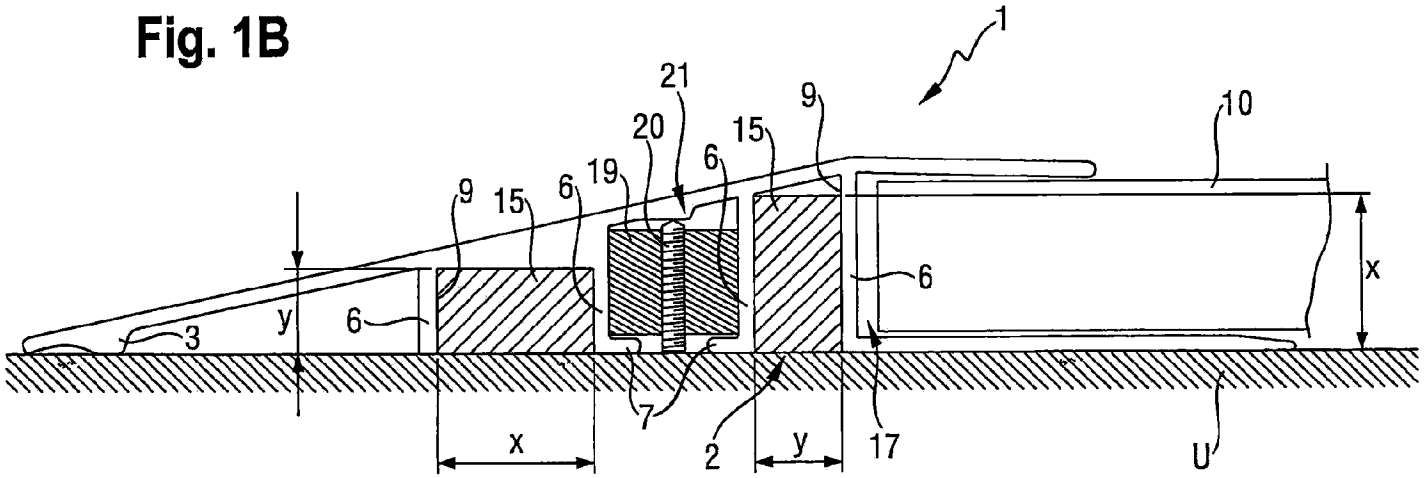
FIG. 1B shows a floor profile arrangement in an embodiment as an angle profile.

FIG. 1B is a sectional view of a profiled strip 1 in an embodiment as an angle profile. In addition to the features of FIG. 1A, this configuration has an angle joint 19 which extends between the webs 6 and is introduced above the legs 7. The angle joint 19 is preferably made of aluminium and has, in regular spacings, tapped holes into which screws 20 have been introduced as attachment means. Furthermore, a bead 21 which extends in the longitudinal direction is formed on the profiled strip 1 as a means which provides the screw 20 with a planar contact surface. Without the bead 21, the screw 20 would tilt when applied against the slope of the ramp-shaped profiled strip 1. In the case of angle profiles, the angle joints 19 are introduced ex works and, like the joining means 15, can partly project above the cut edges and thus reinforce the positive effect of the joining means 15. The screws 20 extend vertically substantially over the entire height of the profiled strip. When the screws 20 are tightened, the angle joint 19 is supported against the legs 7 and allows the cut edges to lie flush against each other.

Figure 2:
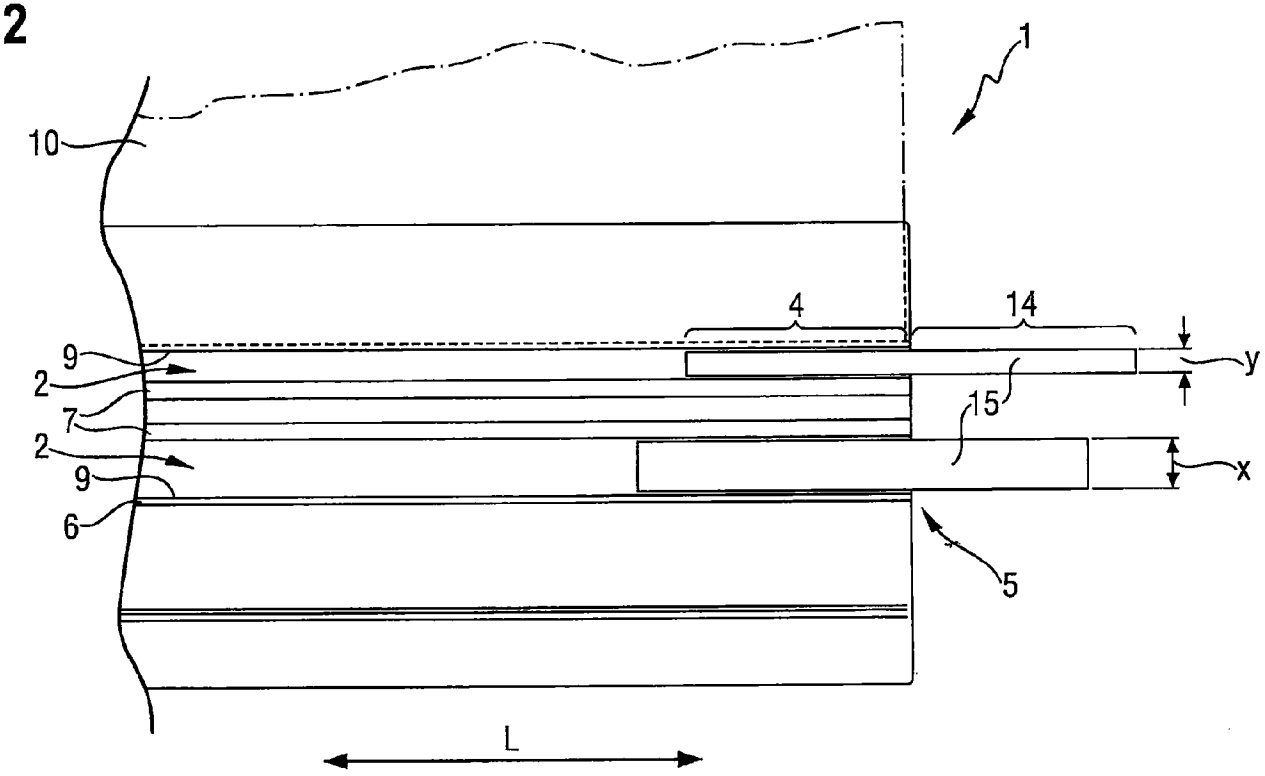
FIG. 2 is a bottom view of a floor profile arrangement or of a ramp profile.

FIG. 2 is a bottom view of the profiled strip 1 from FIG. 1, the profiled strip 1 having two retaining means 2, by which in each case a first segment 4 of the joining means 15 is held, a second segment 14 of the joining means 15 protruding over a peripheral region 5 of the profiled strip 1 in the longitudinal direction L to join with a further profiled strip (not shown).

The two joining means 15 have an identical shape, i.e. length, height and width, but are oriented differently, namely one joining means 15 is arranged vertically and the other is arranged horizontally. Furthermore, both joining means are inserted to different extents inside the profiled strip 1 or inside the ramp profile. The position of both means 15 can be altered in the longitudinal direction by removing them and inserting them by hand.

As also shown by FIG. 2, the first segment 4 of the joining means 15 is formed by a retaining means 2 consisting of webs 6 and it provides retaining surfaces 9 for holding the joining means 15. With its webs, the retaining means 2 forms a channel which extends in the longitudinal direction of the profiled strip 1 from the peripheral region 5 to a further peripheral region (not shown). Accordingly, the joining means 15 is encompassed non-positively and positively by the retaining means 2. In order to achieve a non-positive and positive locking, the joining means 15 is pushed into the retaining means 2 from the peripheral portion 5 in the longitudinal direction or is pressed in from the lower side.

A floor covering 10 is also shown in engagement between both sides of the ramp profile.

Figure 3:
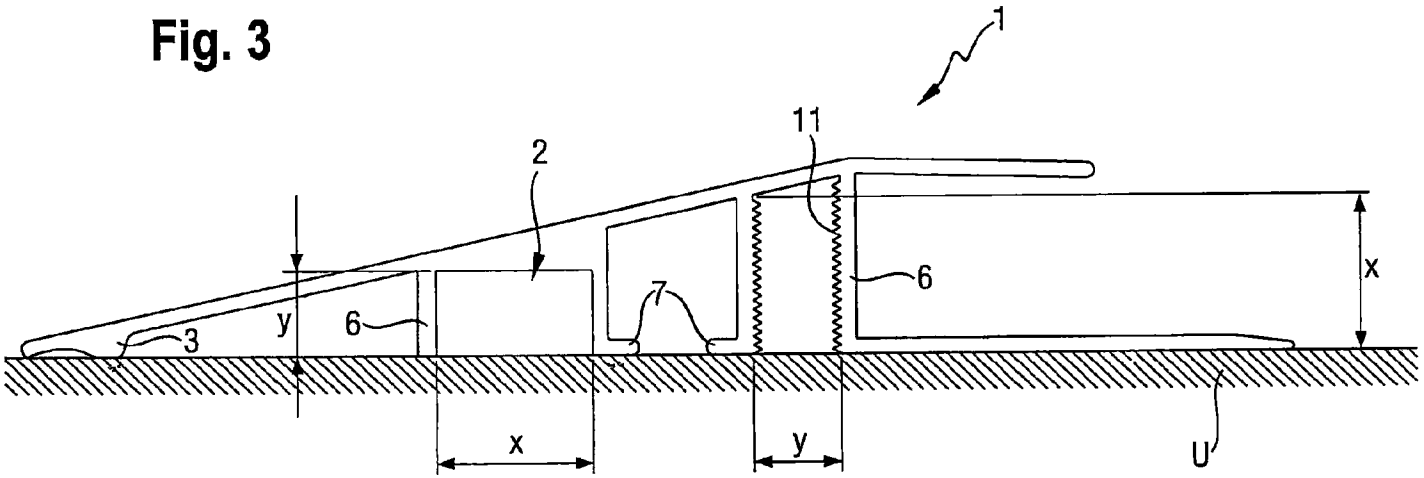
FIG. 3 shows a floor profile arrangement similar to FIG. 1 in a further embodiment.

FIG. 3 basically shows the features of FIG. 1, but without joining means 15 or floor covering 10. Instead, a profiling 11 is formed in place of the retaining surfaces 9.

The profiling 11 has a type of pattern and is only formed on the right-hand retaining means 2. A profiling of this type can also be provided on the second retaining means. In the illustrated embodiment, the pattern extends from the substrate U over the entire length or height of the web 6 and leg 7. Such a configuration is not absolutely necessary; the pattern can likewise be discontinued from the end and/or also from the start of a web 6 and/or of a leg, so that for example a pattern is only produced at the central level.

Figure 4:
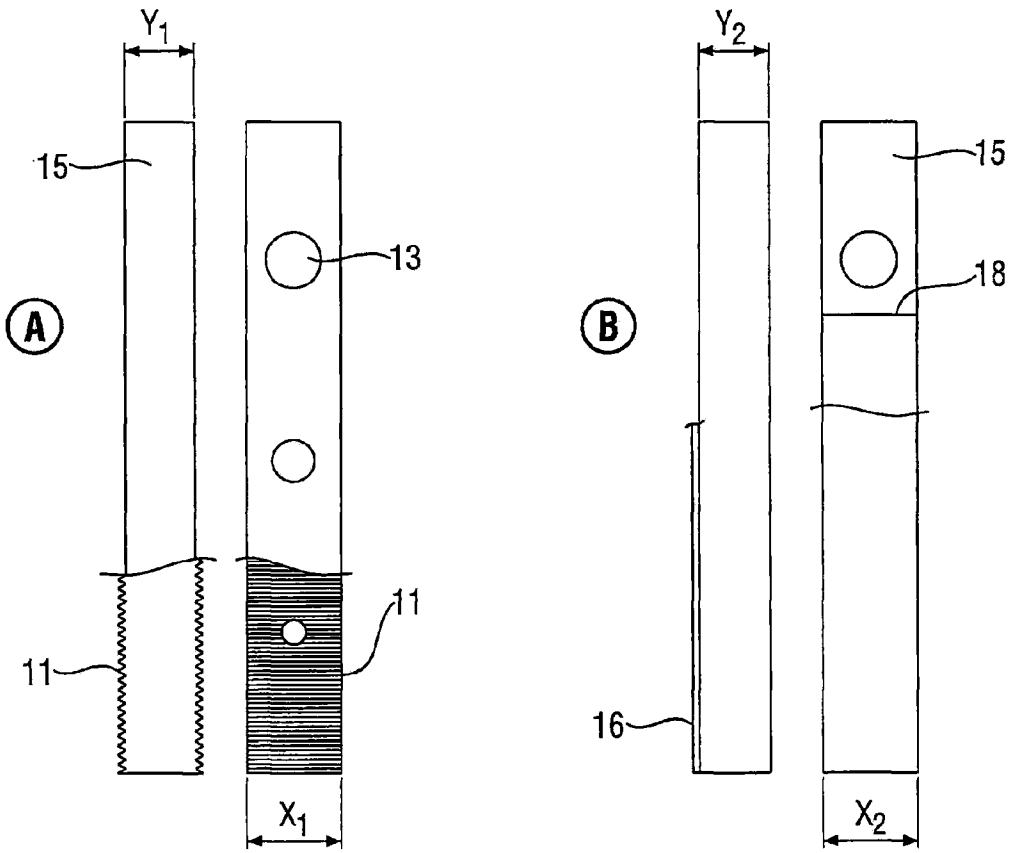
FIG. 4 shows embodiments of joining means.

FIG. 4 shows two variants of embodiments of joining means 15 which have identical heights and widths (X1=X2), but different thicknesses (Y1, Y2).

The cuboidal shape allows a simple installation between joining means 15 and retaining means 2, without there being any doubt as to where which joining means 15 is to be mounted. Thus, stress concentrations can be reduced during the transmission of forces along a large surface, and it is possible to maximise the friction adhesion between joining means 15, profiled strip 1 and adhesive which may be introduced between them.

Thus, variant A shows a joining means 15 with a planar, smooth surface as well as a joining means 15 with a profiling 11. A non-positive and positive locking is thus ensured even more effectively via the profiling 11 on the joining means 15 and the profiled strip 1, since the profiled strip 1 can now engage in the profiling 11 of the joining means.

In addition, all the joining means 15 are arranged on the relatively larger side of the cuboid and are configured with differently formed recesses 13 to receive adhesives. This provides the advantage that adhesive (not shown) can be applied in the recesses and the joining means 15 can be adhesively bonded to the retaining means 2. Thus, it is possible to achieve ex works a correct, unchangeable pre-assembly of joining means inside the retaining means and it is possible to avoid a faulty installation of the joining means 15 in the profiled strip 1 or in the retaining means 2. Furthermore, it is thus possible to reduce production complexity and therefore production costs, because the manufacturing tolerances are smaller for a join of this type. The recesses 13 are also used as a space for levelling out the material if the joining means 15 are elastically deformed.

In a further preferred configuration according to variant B, the joining means 15 has an adhesive film on the outside. When the joining means 15 is installed with the retaining means 2 of the profiled strip 1, the use of adhesive film means that it is possible to avoid the additional use of adhesives, and the same effect is achieved as with adhesives.

A predetermined breaking point 18 is also shown in FIG. 4, variant B. By means of said predetermined breaking point 18, it is easily possible to shorten the length of the joining means 15.

Instead of the illustrated circular recesses 13, turned rectangular recesses as well as oval recesses are possible with different orientations on the joining means. Variant A shows different sizes of round recesses 13. All the variations in shape mentioned provide different contact surfaces for the profiled strip and require different quantities of adhesives. The size of the recesses 13 depends on the size of the profiled strips and of the joining means.

Figure 5:
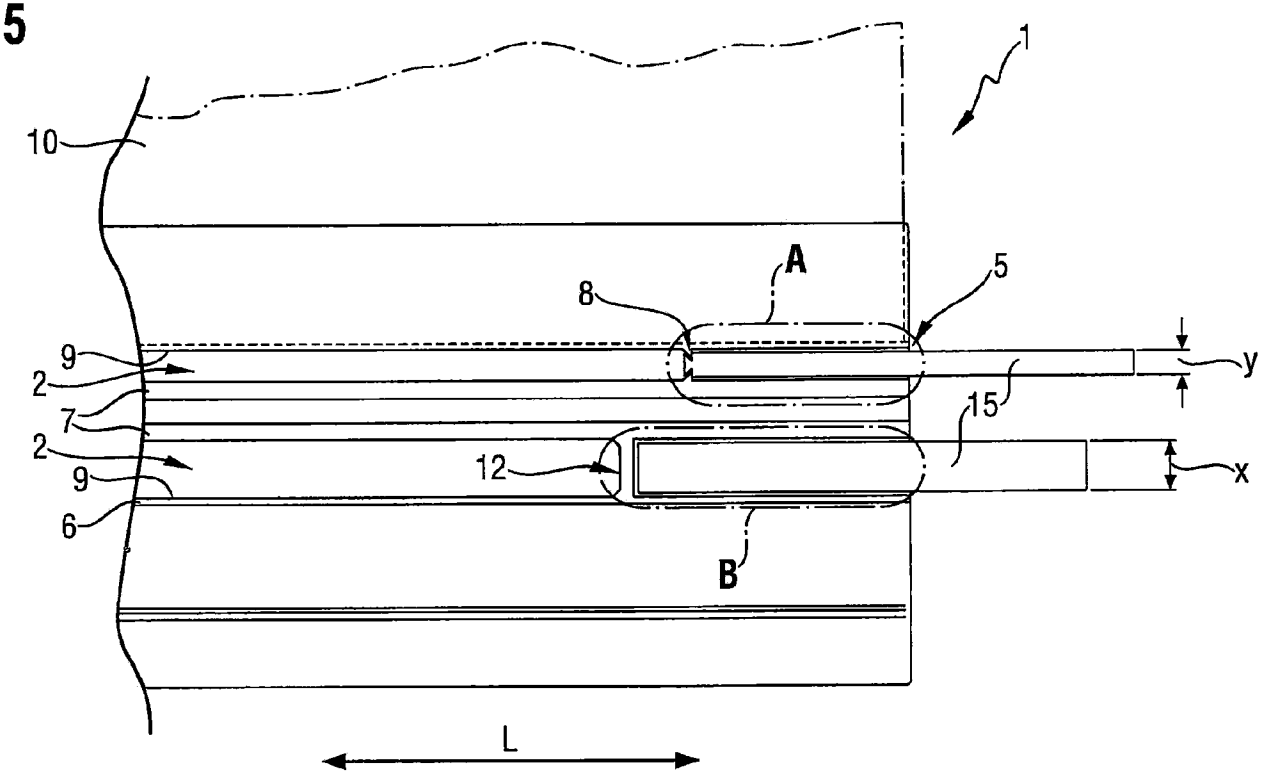
FIG. 5 shows a floor profile arrangement substantially according to FIG. 2 in a further embodiment.

FIG. 5 basically shows the features of FIG. 2, except that configured on the upper joining means 15 (configuration A) on the end made in the profiled strip 1 is a dovetail retaining means 8 and retaining surfaces 9 for holding the joining means 15.

A configuration of the retaining means 2 formed in this way means that a non-positive and positive engagement or retention between joining means 15 and profiled strip 1 is reliably ensured. As shown in configuration B in FIG. 5, a stop 12 is provided which restricts displaceability in the longitudinal direction L of a joining means 15 in the retaining means 2.

In the illustrated embodiment, the stop 12 is formed as a joining element between a web 6 and a leg 7. In this respect, the joining element is configured such that it forms a continuous wall from the substrate to the upper side. However, a configuration as a web or a nose which projects into the retaining means 2 and does not fully extend from the upper side to the substrate or from the web 6 to the leg 7 can also be used as an alternative.

The advantage of a longitudinally restricting stop not only provides the adjustment of the optimum length inside the profiled strip for the transmission of forces and moments onto the adjoining profiled strip, but also the advantage of avoiding faulty installation of the joining means inside the retaining means.

Figure 6:
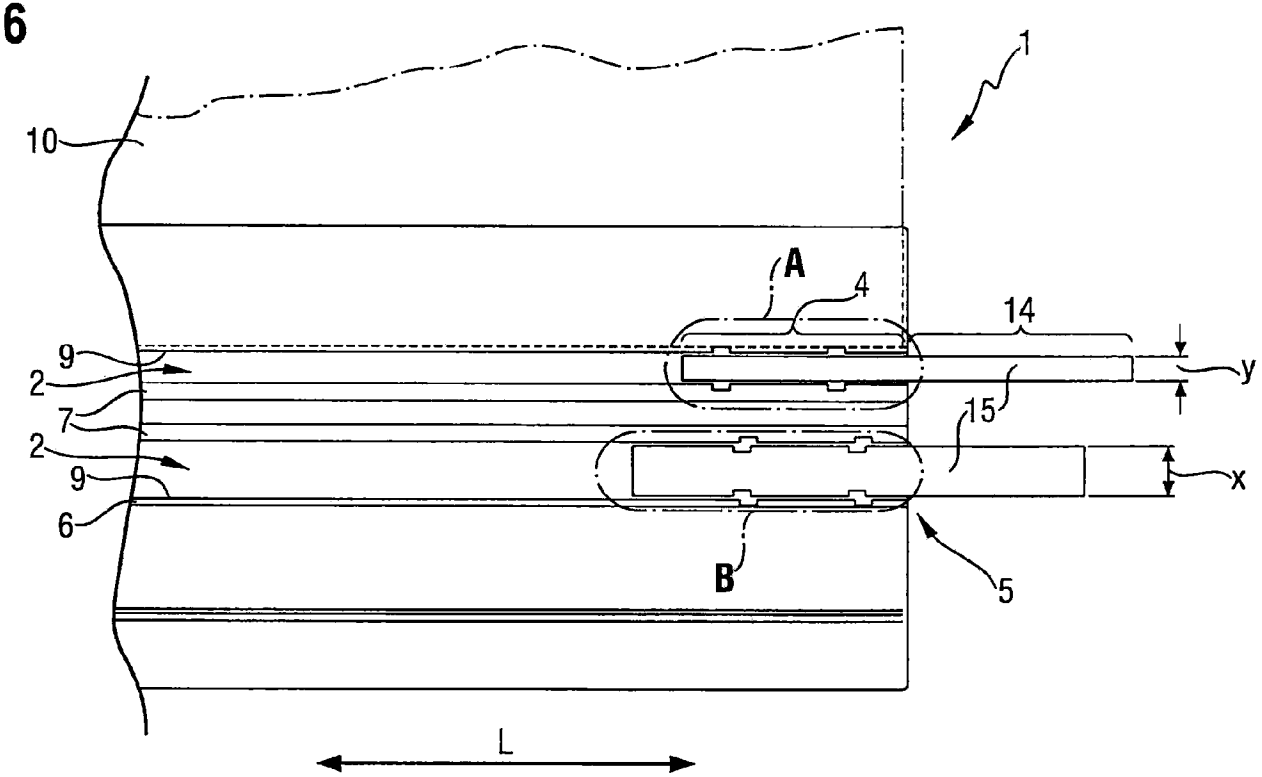
FIG. 6 is a bottom view of a floor profile arrangement in a further embodiment.

Like FIG. 2, FIG. 6 is a bottom view of a profiled strip 1, said profiled strip 1 having two retaining means 2. Here, in each case a first segment 4 of the joining means 15 is held in the profiled strip 1 and a second segment 14 of the joining means 15 projects over the peripheral region 5 in the longitudinal direction L.

The two joining means 15 have identical shapes and they are both inserted to different extents inside the profiled strip 1 or inside the ramp profile.

In configuration A, the profiled strip 1 has recesses which are used to receive adhesive (not shown). Thus, the joining means 15 can be adhesively bonded to the retaining means 2 and a frictional connection can be provided between joining means 15 and profiled strip 1.

Configuration B is similar to configuration A, but here the joining means 15 also has recesses for receiving adhesives. The recesses 13 in the joining means 15 are in an offset arrangement to the recesses in the profiled strip. A joining channel is thus formed for the adhesive between both recesses, an additional part of the retaining surface 9 coming into contact with the adhesive. Consequently, adhesive only has to be applied once into a pair of recesses to join them together and to the retaining surfaces.

Furthermore, such an arrangement of the adhesive not only increases the contact forces between opening means and profiled strip but, when it has hardened, the adhesive also forms a retaining hook.

These recesses are also used to make sure visually that the joining means 15 has been correctly positioned inside the profiled strip 1 in the longitudinal direction L. A stop 12 according to FIG. 5, configuration B is then not required.

The configuration of the invention is not restricted to the preferred embodiments described above. Instead, a number of variants are conceivable which use the illustrated solution even if the configurations are fundamentally different. Thus, for example, it is possible for the joining means to be held in the retaining means of the profiled strip by means of a dovetail retaining means and an adhesive film and adhesives. A combination of a profiling on one side of a joining means and a smooth surface on the other side is also possible.

The invention claimed is:

1. A floor profile arrangement securing floor coverings, the floor profile arrangement comprising:

at least one profiled strip which has a first means for retaining which holds a first means for joining and a second means for retaining which holds a second means for joining, the first and second joining means project over a peripheral region of the profiled strip in a longitudinal direction to join with a further profiled strip; wherein each of the first and second joining means has a single rectangular cross section defining a longer wall and a shorter wall smaller than the longer wall, the longer wall of the first joining means extending vertically from a lower side of the at least one profiled strip and the longer wall of the second joining means extending horizontally, coplanar with the lower side of the at least one profiled strip.

2. The floor profile arrangement according to claim 1, wherein the floor profile arrangement is configured as an angle profile with an angle joint and the angle joint positively joins at least two profiled strips at a predefined angle.

3. The floor profile arrangement according to claim 1, wherein at least one of the first and second retaining means is formed from webs or legs or a dovetail and provides retaining surfaces for holding a respective joining means.

4. The floor profile arrangement according claim 1, wherein at least one of the first and second retaining means engages around a respective joining means in a non-positive and positive manner.

5. The floor profile arrangement according to claim 1, wherein at least one of the first and second joining means can be attached to a respective retaining means such that the at least one of the first and second joining means can be removed therefrom.

6. The floor profile arrangement according to claim 1, wherein at least one of the first and second retaining means has at least one profiling and a respective joining means is configured to engage in the profiling.

7. The floor profile arrangement according to claim 6, wherein the at least one of the first and second joining means is adhesively bonded to the respective retaining means.

8. The floor profile arrangement according to claim 6, wherein the at least one of the first and second joining means has an adhesive film on an outside surface.

9. The floor profile arrangement according to claim 1, wherein the at least one profiled strip together with the first and second joining means forms a flush end surface on the lower side.

10. The floor profile arrangement according to claim 1, wherein at least one of the first and second retaining means has a stop which restricts displaceability of a respective joining means in the longitudinal direction.

11. The floor profile arrangement according to claim 1, wherein at least one of the first and second joining means is adhesively bonded to a respective retaining means.

12. The floor profile arrangement according to claim 1, wherein at least one of the first and second joining means or the profiled strip or at least one of the first and second retaining means has at least one recess for receiving adhesives.

13. The floor profile arrangement according to claim 12, wherein the at least one recess is on a relatively larger side of the at least one of the first and second joining means which is in contact with a respective retaining means.

14. The floor profile arrangement according claim 1, wherein at least one of the first and second joining means has an adhesive film on an outside surface.

15. The floor profile arrangement according to claim 1, wherein at least one of the first and second joining means is formed from plastics material or hard rubber.

16. The floor profile arrangement according to claim 1, wherein each of the first and second joining means has an identical single cuboidal shape.

17. A floor profile arrangement securing floor coverings, the floor profile arrangement comprising:

at least one profiled strip which has a first means for retaining which holds a first means for joining and a second means for retaining which holds a second means for joining, the first and second joining means project over a peripheral region of the profiled strip in a longitudinal direction to join with a further profiled strip; wherein each of the first and second joining means has a rectangular cross section having a first side and a second side longer than the first side, the second side of the first joining means extending vertically, the second side of the second joining means extending horizontally;

the second side of the second joining means is coplanar with a lower side of the at least one profiled strip; and the first side of the first joining means is coplanar with the lower side of the at least one profile strip.

18. The floor profile arrangement according to claim 17, wherein each of the first and second joining means has a cuboidal shape.

19. The floor profile arrangement according to claim 18, wherein each of the first and second joining means has an identical cuboidal shape.

* * * * *